US009850728B2

(12) United States Patent
Wessel

(10) Patent No.: US 9,850,728 B2
(45) Date of Patent: Dec. 26, 2017

(54) WIRELINE DRILLING SYSTEM

(71) Applicant: INNOVA DRILLING AND INTERVENTION LIMITED, Aberdeen (GB)

(72) Inventor: Roland Wessel, London (GB)

(73) Assignee: INNOVA DRILLING AND INTERVENTION LIMITED, Aberdeen (GB)

( * ) Notice: Subject to any disclaimer, the term of this patent is extended or adjusted under 35 U.S.C. 154(b) by 585 days.

(21) Appl. No.: 14/361,024

(22) PCT Filed: Nov. 28, 2012

(86) PCT No.: PCT/GB2012/052934
§ 371 (c)(1),
(2) Date: May 28, 2014

(87) PCT Pub. No.: WO2013/079935
PCT Pub. Date: Jun. 6, 2013

(65) Prior Publication Data

US 2014/0326510 A1 Nov. 6, 2014

(30) Foreign Application Priority Data

Nov. 28, 2011 (GB) ..... 1120449.2

(51) Int. Cl.
*E21B 7/00* (2006.01)
*E21B 27/04* (2006.01)
(Continued)

(52) U.S. Cl.
CPC ..... *E21B 27/04* (2013.01); *E21B 4/04* (2013.01); *E21B 7/006* (2013.01); *E21B 17/206* (2013.01); *E21B 34/14* (2013.01)

(58) Field of Classification Search
CPC ..... E21B 27/04; E21B 17/206; E21B 7/06; E21B 34/14; E21B 4/04; E21B 7/006
See application file for complete search history.

(56) References Cited

U.S. PATENT DOCUMENTS 2,116,359 A * 5/1938 McCann ..... E21B 7/006 175/262
2,187,845 A * 1/1940 Tatalovich ..... E21B 27/04 166/104

(Continued)

FOREIGN PATENT DOCUMENTS

GB 2 416 550 2/2006
WO WO 00/58602 10/2000

(Continued)

OTHER PUBLICATIONS

Schlumberger Oilfield Glossary entry for "round trip", accessed Nov. 4, 2016 via www.glossary.oilfield.slb.com.*

(Continued)

*Primary Examiner* — Blake E Michener
(74) *Attorney, Agent, or Firm* — Nixon & Vanderhye P.C.

(57) ABSTRACT

A wireline drilling system for the hydrocarbon exploration and production industry incorporating a drilling cuttings removal system which acts to remove and store cuttings displaced by a drill bit during drilling operations. The cuttings removal system may employ a screw member having a tapered lower portion and a narrow upper portion to transport drilling cuttings to a cuttings basket and distribute the cuttings therein. Embodiments of the invention include an integral tractor to progress the wireline drilling system and provide weight-on-bit, as well as assist in retrieval of the wireline drilling system if the tool should become stuck.

29 Claims, 8 Drawing Sheets

(51) Int. Cl.

| | |
|---|---|
| ***E21B 4/04*** | (2006.01) |
| ***E21B 17/22*** | (2006.01) |
| ***E21B 17/20*** | (2006.01) |
| ***E21B 34/14*** | (2006.01) |

(56) References Cited

U.S. PATENT DOCUMENTS

| | | | | |
|---|---|---|---|---|
| 2,735,703 | A * | 2/1956 | Goodman | E21B 7/006 175/388 |
| 2,915,288 | A * | 12/1959 | Crapez | E02D 7/28 173/109 |
| 3,232,361 | A * | 2/1966 | Haspert | E21B 6/00 175/102 |
| 6,695,058 | B1 * | 2/2004 | French | E21B 21/002 166/173 |
| 7,946,360 | B2 * | 5/2011 | Orban | E21B 4/18 175/321 |
| 8,109,331 | B2 * | 2/2012 | Lynde | E21B 37/00 166/105.3 |
| 9,334,704 | B2 * | 5/2016 | Mineo | E21B 34/063 |
| 2006/0231258 | A1 * | 10/2006 | Head | E21B 29/06 166/298 |
| 2007/0272404 | A1 * | 11/2007 | Lynde | E21B 27/005 166/99 |
| 2008/0023033 | A1 * | 1/2008 | Potter | E21B 27/04 134/10 |
| 2010/0025115 | A1 * | 2/2010 | Kotsonis | E21B 4/18 175/61 |
| 2012/0160503 | A1 * | 6/2012 | Davis | E21B 21/08 166/330 |
| 2015/0240583 | A1 * | 8/2015 | Mineo | E21B 34/063 166/311 |

FOREIGN PATENT DOCUMENTS

| | | |
|---|---|---|
| WO | WO 2005/071208 | 8/2005 |
| WO | WO 2009/062726 | 5/2009 |

OTHER PUBLICATIONS

International Search Report for PCT/GB2012/052934, dated Jan. 27, 2014.

Written Opinion of the ISA for PCT/GB2012/052934, dated Jan. 27, 2014.

* cited by examiner

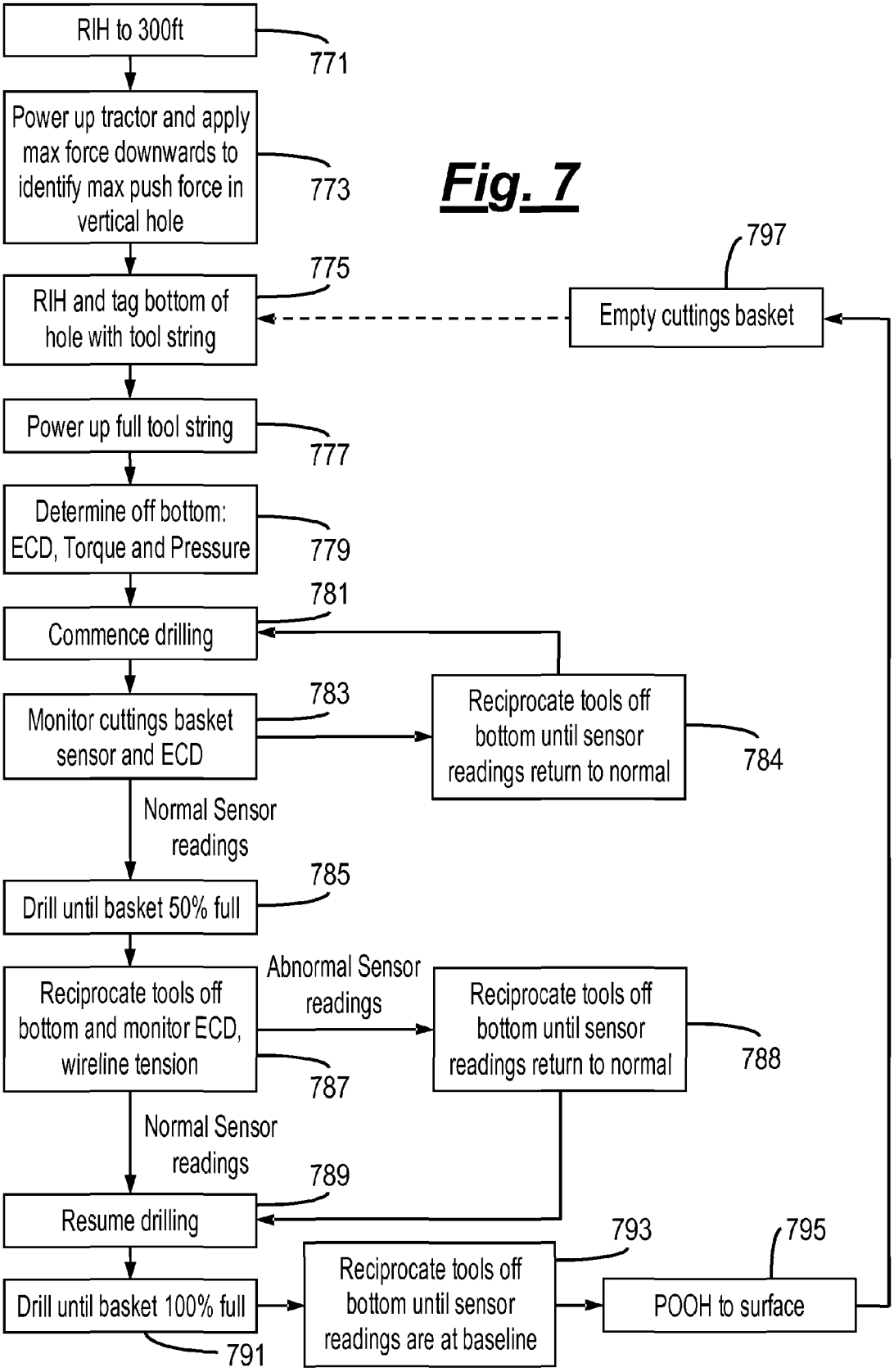
RIH to 300ft
771
Power up tractor and apply max force downwards to identify max push force in vertical hole
773
Fig. 7
797
775
RIH and tag bottom of hole with tool string
Empty cuttings basket
Power up full tool string
777
Determine off bottom: ECD, Torque and Pressure
779
781
Commence drilling
783
Monitor cuttings basket sensor and ECD
Reciprocate tools off bottom until sensor readings return to normal
784
Normal Sensor readings
785
Drill until basket 50% full
Abnormal Sensor readings
Reciprocate tools off bottom and monitor ECD, wireline tension
Reciprocate tools off bottom until sensor readings return to normal
788
787
Normal Sensor readings
789
Resume drilling
793
795
Drill until basket 100% full
Reciprocate tools off bottom until sensor readings are at baseline
POOH to surface
791

WIRELINE DRILLING SYSTEM

This application is the U.S. national phase of International Application No. PCT/GB2012/052934 filed 28 Nov. 2012 which designated the U.S. and claims priority to GB Patent Application No. 1120449.2 filed 28 Nov. 2011, the entire contents of each of which are hereby incorporated by reference.

The present invention relates to an improved wireline drilling system for the hydrocarbon exploration and production industry, and in particular a wireline drilling system having an integrated cuttings removal system. In a particular embodiment of the present invention, the wireline drilling system includes a screw member arranged to transport cuttings to an integral cuttings collection basket, and an integral tractor to progress and provide weight on bit.

BACKGROUND TO THE INVENTION

After extended periods of hydrocarbon production, many wells suffer from near-borehole formation damage which restricts future production. At such times it is clearly desirable to enhance production and this calls for well intervention to access and/or release the remaining hydrocarbon reserves.

Commonly, well intervention will include sidetracking the existing well—however this generally requires the use of an expensive drilling rig or coiled tubing drilling unit. However, low-cost wells do not economically justify the cost and down-time associated with such well intervention methods, and in any case even with high-cost wells it is extremely desirable to minimise down-time.

Alternatively, it is known to work over by effectively replacing the completion but this is understandably a costly procedure and success is not guaranteed—particularly if the formation has been seriously damaged. Re-perforating, acid washing and other chemical treatments might provide only temporary improvement in production and will also be of limited efficacy if the formation has been damaged and may, particularly with chemical treatments, damage the formation further.

Environmental concerns provide numerous disincentives to employ hydraulic fracturing fluids or other chemical intervention methods, including potential contamination of ground water and effects on air quality. There are also difficulties in predicting how a formation will react to a particular fracturing attempt, and despite lack of conclusive evidence concerns remain regarding inducing earthquakes or ground tremors by injection of fluids into deep wells.

Radial drilling has been employed in well intervention operations, in which coiled tubing and jetting technology is used to drill small diameter wellbores from an existing wellbore to expose clean formation for enhanced hydrocarbon production. However, jetting technology is not always effective in drilling the formation, and coiled tubing units are expensive.

Drilling techniques are preferable to jetting techniques, particularly in well intervention operations. However, problems are inherent in drilling operations—and particularly when sidetracking the existing well or drilling open hole laterals. One such problem lies in the removal of drilling cuttings which would otherwise block production and therefore render drilling operations counterproductive.

In WO 2009/062726, a method of removing cuttings from a workfront of a lateral borehole is described in a series of steps, namely transporting cuttings from the workface to behind the drilling tool, from behind the drilling tool to the junction with the main well, and from the junction to a place of disposal. Various methods of transporting the cuttings from behind the drilling tool are suggested, including withdrawing the drilling tool or using shuttling transport devices. However, the transportation methods disclosed appear to lack mechanical efficiency, and it is suggested that the effectiveness of cuttings removal is correspondingly limited.

GB 2416550 describes a drilling tool that, in a lateral wellbore, employs a first pump to circulate fluid to clear cuttings from the drilling bit and along the wellbore, and a second pump that circulates fluid through the lateral wellbore to transport cuttings out of the lateral wellbore. This relies upon a system of multiple pumps, which in itself is mechanically and (in wireline operations) would be electrically inefficient. Furthermore, it is not clear how the cuttings are subsequently removed from the main wellbore, or how to ensure cuttings in the lateral wellbore are efficiently removed to prevent blockages.

Disclosed in U.S. Pat. No. 7,487,846 is a wireline drilling method in which an electric motor is employed to reverse circulate production fluid through the drill bit to remove drilling cuttings. In the event of blockage in the drill bit it is anticipated that the reverse circulated fluid would compound the blockage at bottomhole and risk jamming the drill bit. Furthermore, this system requires the well to be on production which renders it ineffective for well intervention operations where production may in fact have halted.

In each of the disclosures described above, drilling cuttings are moved along the borehole during drilling; however there is no disclosure of how the cuttings may be removed from the wellbore fluid, or indeed from the well, in an efficient manner.

A drilling tool is described in DE 2808206 that comprises a rotatable cutting member, an impeller to circulate fluids and a separator that separates entrained material from the circulating fluid by means of a filter and store said entrained material in the tool. However, the applicant has realised that provision of an impeller and an opening to receive fluids with entrained drilling cuttings is not sufficient to ensure efficient cuttings capture.

WO 00/58602 discloses a cleaning tool used for cleaning casing-lined boreholes which includes a solids collection device, and U.S. Pat. No. 1,880,214 and U.S. Pat. No. 2,116,359 relate to drilling systems rotated from surface which include provisions for cuttings capture.

It is an object of aspects and/or embodiments of the present invention to provide a means for efficient collection, storage and/or removal of drilling cuttings when drilling or sidetracking wellbores, or drilling open hole laterals from a main wellbore in well intervention operations. Further aims and objects will become apparent from reading the following description.

SUMMARY OF THE INVENTION

According to a first aspect of the invention, there is provided a wireline drilling system comprising a drilling assembly configured to drill a wellbore, and an integral cuttings removal system arranged to collect and store cuttings displaced by the drilling assembly for transport to the surface, the integral cuttings removal system comprising a cuttings basket to store the drilling cuttings and a rotatable screw member operable to carry drilling cuttings along at least a portion of the integral cuttings removal system.

The rotatable screw member can thereby transport drilling cuttings to the cuttings basket and/or distribute drilling cuttings within the cuttings basket. The rotatable screw member may transport drilling cuttings in an upwards direction of the system (i.e. an upward direction in the wellbore or sidetrack being drilled). Upwards in this context is intended to mean in a direction towards the opening to the wellbore or side track axially in the bore, not withstanding that the application may be used in inclined wellbores. The rotatable screw member may transport drilling cuttings away from an inlet in fluid communication with the screw member, so that a fluid and cuttings mixture may be delivered to the screw member via the inlet, and may be transported by the screw member away from the inlet.

The one or more inlets may be positioned at or near a lower portion of the screw member.

Note that for the purposes of defining the scope of the present invention, wireline shall be understood as encompassing slickline or other flexible conveyance types. Furthermore, the rotatable screw member will be understood by the skilled person to encompass any functionally equivalent member that is able to transport cuttings along its length, to the cuttings basket, when rotated and or moved. In this way, the rotatable screw member will be understood as not being strictly limited to a helical screw and may, for example, comprise flat portions.

Preferably the rotatable screw member comprises a first portion and a second portion, the first portion arranged to distribute cuttings within the cuttings basket, and the second portion arranged to transport cuttings to the cuttings basket. Preferably, a diameter of the first portion is smaller than a corresponding diameter of the second portion. Optionally, the rotatable screw member is an Archimedes' screw.

Advantageously, the second portion is tapered. Preferably, an inner surface of the cuttings removal system is tapered so as to correspond to the tapered lower portion of the screw member.

Preferably, the cuttings removal system comprises one or more inlets positioned at or near the lower portion of the screw member. Most preferably, the cuttings removal system comprises a pump configured to circulate fluid between the drilling assembly and the cuttings removal system via the one or more inlets. The pump may be of a screw type or an impeller type. Preferably the pump is configured for forward circulation.

Advantageously, the cuttings removal system is configured and/or arranged to provide a pressure differential between the bottom and the top of the system. Such pressure differential reduces the potential for fall-back of cuttings and helps retain the cuttings in the cuttings basket.

Preferably, the wireline drilling system comprises inlets to a rotatable screw member, which may provide fluid communication between a wellbore and the rotatable screw member. The inlets may be configured to receive a mixture of drilling fluids and entrained solids, and may deliver the mixture to a position in which it is exposed to the screw member. Preferably the system is configured to deliver the mixture to a position in which it is exposed to the screw member by a pump circulation pressure.

The inlets may be provided in a body member of the wireline drilling system and may be located at diametrically opposite sides of the body member. The inlets may be part-annular, and/or may be arranged at an angle inclined to the normal radial direction of the body member. The inlets may be bound by upper and lower conical surfaces.

The drilling system may comprise outlet conduits which may be axially oriented in the body member, and which may extend axially through apertures defining the inlets. The outlet conduits may be isolated from the apertures, but may provide a circulation path from the apertures to a central bore of the drilling system. The circulation path is preferably via a volume into which the screw member penetrates.

Preferably the wireline drilling system comprises a filter functioning to enable fluid to enter into the outlet conduits, but preventing the passage of solids.

Most preferably, the wireline drilling system further comprises a tractor configured to selectively engage the wellbore and produce an axial displacement of the wireline drilling system within the wellbore. Preferably, the tractor is configured to displace the wireline drilling system at two or more different speeds. Most preferably, the tractor is configured to provide weight on bit to urge the drilling assembly against a formation being drilled. Optionally, the tractor comprises one or more gripping members. The gripping members may be operated in a crawling mode. Alternatively, the tractor comprises one or more wheeled portions. The wheeled portions may be operated in a continuous drive mode.

Preferably, the wireline drilling system comprises one or more articulated portions to permit longitudinal deflection of the wireline drilling system. The articulated portions may comprise flexible elastomer rubber sections. Optionally, the tractor is coupled to the cuttings removal system by a ball joint. Alternatively, the tractor is coupled to the cuttings removal system by a flexible elongate member which provides an axial separation therebetween.

Preferably, the cuttings basket comprises at least one sensor configured to determine a quantity of cuttings contained therein. Preferably, the at least one sensor comprises one or more pairs of electrodes disposed on an inner surface of the cuttings basket, separated by an insulating material, each of the one or more pairs of electrodes configured to determine a resistivity therebetween. Optionally, the at least one sensor is configured to determine a formation composition based on the resistivity of cuttings in the cuttings basket.

Preferably, the drilling assembly comprises a drilling motor and a drill bit rotated by the drilling motor. Optionally, the drilling assembly comprises a gearbox between the drilling motor and drill bit. The drill bit may be of a poly-crystalline diamond compact (PDC) type or diamond impregnated type. Optionally, the drilling assembly is configured to resonate or oscillate the drill bit during drilling. The drilling assembly may be provided with a resonating head for this purpose.

Optionally, the wireline drilling system further comprises an adjustable bend arranged to effect an off-axis deviation of the drilling assembly. Preferably, the adjustable bend is controllable to control a drilling direction. Alternatively, or additionally, drilling direction may be controlled by modulation of rotation of the drill bit, or of the resonating head as appropriate.

Preferably, the wireline drilling system further comprises one or more sensors selected from the group comprising; a calliper sensor to determine the diameter of the wellbore; an orientation sensor to determine the orientation of the drilling assembly; a pressure sensor to determine the annular pressure in the wellbore; an RPM sensor to determine the speed of rotation of the drill bit; a torque sensor to determine the torque applied to the drill bit; and a weight-on-bit sensor to determine the weight-on-bit.

Preferably, the wireline drilling system further comprises a control module configured to control drilling operations responsive to information received from the one or more said sensors.

According to a second aspect of the invention, there is provided a cuttings removal system for collecting cuttings displaced by a drilling assembly for transport to the surface, the cuttings removal system comprising a cuttings basket to store the drilling cuttings and a rotatable screw member operable to transport drilling cuttings along at least a portion thereof to the cuttings basket.

Optionally, the rotatable screw member is an Archimedes' screw. Preferably the rotatable screw member comprises a first portion and a second portion, the first portion arranged to distribute cuttings within the cuttings basket, and the second portion arranged to transport cuttings to the cuttings basket. Preferably, a diameter of the first portion is smaller than a corresponding diameter of the second portion.

Advantageously, the second portion is tapered. Preferably, an inner surface of the cuttings removal system is tapered so as to correspond to the tapered lower portion of the screw member.

Preferably, the cuttings removal system comprises one or more inlets positioned at or near the lower portion of the screw member. Most preferably, the cuttings removal system comprises a pump configured to circulate fluid between the drilling assembly and the cuttings removal system via the one or more inlets. The pump may be of a screw type or an impeller type. Preferably the pump is configured for forward circulation.

Preferably, the cuttings basket comprises at least one sensor configured to determine a quantity of cuttings contained therein. Preferably, the at least one sensor comprises one or more pairs of electrodes disposed on an inner surface of the cuttings basket, separated by an insulating material, each of the one or more pairs of electrodes configured to determine a resistivity therebetween. Optionally, the at least one sensor is configured to determine a formation composition based on the resistivity of cuttings in the cuttings basket.

Embodiments of the second aspect of the invention may include one or more features of the first aspect of the invention or its embodiments, or vice versa.

According to a third aspect of the invention, there is provided a method of drilling using a wireline drilling system according to the first aspect, or a wireline drilling system including a cuttings removal system according to the second aspect, comprising:

running the wireline drilling system into the wellbore;

drilling a formation using the drilling assembly; and collecting cuttings displaced by the drilling assembly.

Most preferably, the method comprises retrieving the wireline drilling system, at least once, to dispose of the collected cuttings. The cuttings may be collected in a cuttings basket of the wireline drilling system. Disposing of the collected cuttings may comprise emptying the cuttings basket, or replacing a full or part-full cuttings basket with an empty cuttings basket.

Preferably, the method comprises determine a quantity of cuttings contained in the cuttings basket. Preferably, the method comprises determining a resistivity of the contents of the cuttings basket. Optionally, the method comprises determining a formation composition based on the resistivity of the contents of the cuttings basket.

Preferably, the method comprising retrieving the wireline drilling system to dispose of the collected cuttings responsive to determining the quantity of cuttings contained in the cuttings basket.

Preferably, the method comprises rotating a screw member to transport drilling cuttings to the cuttings basket. Preferably the method comprises rotating a screw member within the cuttings basket to distribute cuttings within the cuttings basket.

Most preferably, the method comprises circulating fluid between the drilling assembly and the cuttings removal system via one or more inlets. Preferably the pump is operated to provide forward circulation. Circulation of fluid entrains drilling cuttings in the fluid which are subsequently transported to the cuttings basket.

Most preferably, the method comprises selectively engaging a tractor of the wireline drilling system to produce an axial displacement of the wireline drilling system within the wellbore. Preferably, the method comprises displacing the wireline drilling system at two or more different speeds.

Most preferably, the method comprises producing an axial displacement using the tractor to provide weight on bit to urge the drilling assembly against a formation being drilled. The tractor may be operated in a crawling mode. Alternatively, the tractor may be operated in a continuous drive mode.

Optionally, the method comprises powering up the tractor at an intermediate position in the wellbore to determine a maximum push force.

Optionally, the method comprises resonating or oscillating the drill bit during drilling. Optionally, the method comprises fracturing the formation using the resonating or oscillating drill bit.

Optionally, the method comprises controlling an adjustable bend to effect an off-axis deviation of the drilling assembly. Preferably, the adjustable bend is controlled to control a drilling direction. Alternatively, or additionally, drilling direction may be controlled by modulation of rotation of the drill bit, or of the resonating head as appropriate. Further alternatively, or additionally, the method comprises deflecting the wireline drilling system to provide directional drilling. Such deflection may be effected by use of a whipstock.

Optionally, the drilling direction is controlled to drill openhole laterals from the wellbore.

Preferably, the method further comprises controlling drilling operations responsive to information received from one or more sensors. The sensors may be selected from the group comprising; a calliper sensor to determine wellbore diameter; an orientation sensor to determine the orientation of the drilling assembly; a pressure sensor to determine wellbore annular pressure; an RPM sensor to determine the speed of rotation of the drill bit; a torque sensor to determine the torque applied to the drill bit; and a weight-on-bit sensor to determine the weight-on-bit.

Optionally, the method comprises ceasing drilling operations responsive to information received from one or more sensors. Additionally, or alternatively, the method comprises reciprocating the wireline drilling system off bottom responsive to information received from one or more sensors. Drilling operations and/or bottomhole placement may be resumed or cessation/withdrawal maintained responsive to changes or lack of changes in the information received from the one or more sensors.

Embodiments of the third aspect of the invention may include one or more features corresponding to features of the first or second aspects of the invention or their embodiments, or vice versa.

According to a fourth aspect of the invention, there is provided a drilling assembly for a wireline drilling system, the drilling assembly comprising a drilling motor and a drill bit rotated by the drilling motor, and a pump configured to direct fluid from an inlet above the drill bit through the drill bit and circulate the fluid via an annular space between the drilling assembly and a wellbore.

The pump may be of a screw type or an impeller type.

Optionally, the drilling assembly comprises a gearbox between the drilling motor and drill bit. The drill bit may be of a poly-crystalline diamond compact (PDC) type or diamond impregnated type. Optionally, the drilling assembly is configured to resonate or oscillate the drill bit during drilling. The drilling assembly may be provided with a resonating head for this purpose.

Optionally, the drilling assembly further comprises an adjustable bend arranged to effect an off-axis deviation of the drilling assembly. Preferably, the adjustable bend is controllable to control a drilling direction. Alternatively, or additionally, drilling direction may be controlled by modulation of rotation of the drill bit, or of the resonating head as appropriate. Further alternatively, the drilling direction is determined by a whipstock.

Preferably, the drilling assembly further comprises one or more sensors selected from the group comprising; a calliper sensor to determine the diameter of the wellbore; an orientation sensor to determine the orientation of the drilling assembly; a pressure sensor to determine the annular pressure in the wellbore; an RPM sensor to determine the speed of rotation of the drill bit; a torque sensor to determine the torque applied to the drill bit; and a weight-on-bit sensor to determine the weight-on-bit.

Embodiments of the fourth aspect of the invention may include one or more features corresponding to features of any of the first to third aspects of the invention or their embodiments, or vice versa.

According to a fifth aspect of the invention, there is provided a well intervention method including a method of drilling according to the third aspect.

Optionally, the well intervention method comprises drilling open hole laterals from the wellbore.

Preferably, the well intervention method comprises recovering hydrocarbon from the well during or subsequently to drilling the wellbore.

Embodiments of the fifth aspect of the invention may include one or more features corresponding to features of any of the first to fourth aspects of the invention or their embodiments, or vice versa.

According to a sixth aspect of the present invention, there is provided a method of drilling open hole laterals from a wellbore, comprising:

running a wireline drilling system according to the first aspect into the wellbore;

drilling while controlling an orientation of the drilling assembly; and collecting cuttings displaced by the drilling assembly.

Embodiments of the sixth aspect of the invention may include one or more features corresponding to features of any of the first to fifth aspects of the invention or their embodiments, or vice versa.

According to a seventh aspect of the present invention, there is provided a method of drilling comprising:

providing a wireline drilling system in a main wellbore, the wireline drilling system comprising a tractor and a drill bit subassembly connected by a flexible coupling, wherein the tractor is configured to selectively engage the wellbore and produce an axial displacement of the wireline drilling system within the wellbore, and wherein the flexible coupling is operable to transfer weight on bit from the tractor to the drill bit assembly; locating the tractor in a main wellbore and engaging the tractor with the wellbore; and drilling a sidetrack or lateral well with the drilling assembly.

The method may comprise extending the depth of a sidetrack or lateral well by drilling while the tractor is located in the main wellbore.

Embodiments of the seventh aspect of the invention may include one or more features corresponding to features of any of the first to sixth aspects of the invention or their embodiments, or vice versa.

According to an eighth aspect of the present invention, there is provided a wireline drilling system comprising:

a tractor and a drill bit subassembly connected by a flexible coupling, wherein the tractor is configured to selectively engage the wellbore and produce an axial displacement of the wireline drilling system within the wellbore, and wherein the flexible coupling is operable to impart weight on bit from the tractor to the drill bit assembly.

Preferably the wireline drilling system is operable to transfer weight on bit to the drill bit assembly from the tractor assembly via the flexible coupling, when the tractor is located in and engaged with the main wellbore, and the drill bit assembly is drilling a sidetrack or lateral well.

Embodiments of the eighth aspect of the invention may include one or more features corresponding to features of any of the first to seventh aspects of the invention or their embodiments, or vice versa.

According to a ninth aspect of the invention, there is provided a cuttings removal system for collecting cuttings displaced by a drilling assembly for transport to the surface, the cuttings removal system comprising a cuttings basket to store the drilling cuttings and a rotatable screw member operable to distribute cuttings within the cuttings basket.

Embodiments of the ninth aspect of the invention may include one or more features corresponding to features of any of the first to eighth aspects of the invention or their embodiments, or vice versa.

In another aspect of the present invention, there is provided a wireline drilling system comprising a drilling assembly configured to drill a wellbore, and a cuttings removal system arranged to collect cuttings displaced by the drilling assembly for transport to the surface.

Preferably the cuttings removal system comprises a cuttings basket to store the drilling cuttings. Preferably, the cuttings removal system comprises a rotatable screw member operable to transport drilling cuttings along at least a portion thereof to the cuttings basket. Alternatively, or additionally, the rotatable screw member is operable to distribute cuttings within the cuttings basket.

Embodiments of this aspect of the invention may include one or more features corresponding to features of any of the first to ninth aspects of the invention or their embodiments, or vice versa.

According to a tenth aspect of the invention, there is provided method of drilling a wellbore, the method comprising providing a wireline drilling system comprising a drilling assembly and an integral cuttings removal system, the integral cuttings removal system comprising a cuttings basket and a rotatable screw member; running the wireline drilling system into the wellbore; drilling a formation; operating a pump of the wireline drilling system to circulate fluid between the drilling assembly and the rotatable screw member; operating the rotatable screw member to carry drilling cuttings along at least a portion of the integral cuttings removal system; and collecting cuttings displaced by the drilling assembly.

Embodiments of the tenth aspect of the invention may include one or more features corresponding to features of any of the first to ninth aspects of the invention or their embodiments, or vice versa.

BRIEF DESCRIPTION OF THE DRAWINGS

There will now be described, by way of example only, various embodiments of aspects of the invention with reference to the drawings (like reference numerals being used to denote like features), of which:

FIG. 7 is a flow diagram illustrating an exemplary drilling operation in accordance with an embodiment of the present invention, employing a wireline drilling system such as described with reference to FIG. 4, 5 or 6.

DETAILED DESCRIPTION OF PREFERRED EMBODIMENTS

Aspects of the invention are particularly concerned with improvements to drilling operations for well intervention operations, and can be seen to offer improvements over the prior art in terms of efficient collection of drilling cuttings, enhanced volume and efficient usage of cuttings storage, and removal of drilling cuttings from the wellbore. All of these improvements allow realisation of much improved well intervention techniques and make slim hole drilling, for example, an attractive and cost-effective proposition. The following embodiments serve to illustrate these advantages and how they may be achieved in practice. As noted above, where references are made to wireline operations, these shall be understood to include slickline and other flexible conveyance types.

Figure 1:
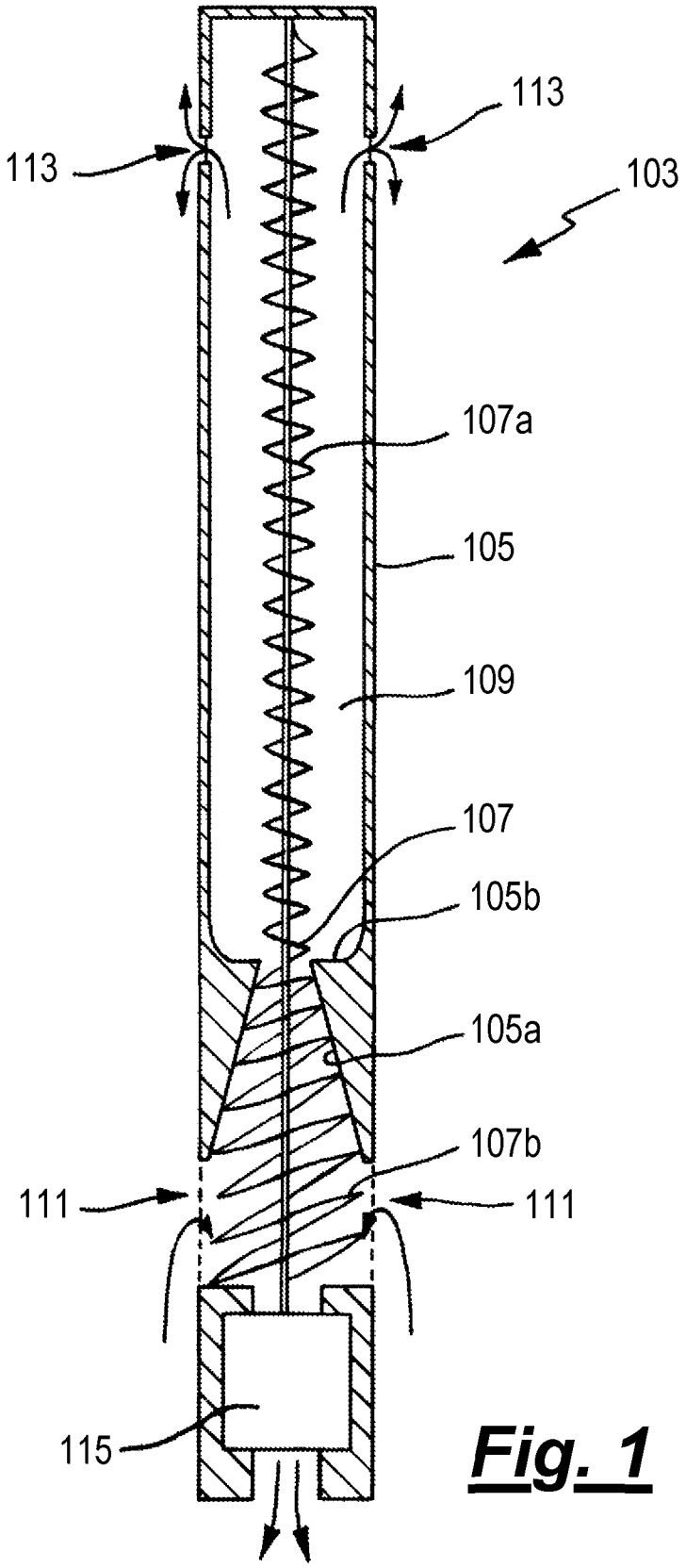
FIG. 1 illustrates in schematic form a cuttings removal system, of a wireline drilling system, in accordance with an embodiment of the present invention.

FIG. 1 illustrates a cuttings removal system 103 for a wireline drilling system (not shown) comprising a hollow cylindrical body member 105 and a screw member 107 extending substantially the full length of the hollow cylindrical body member 105. The screw member 107, while formed as a unitary member in this embodiment, can be seen to comprise two distinct portions; an upper portion 107*a* and a lower portion 107*b*. The lower portion 107*b* of the screw member 107 tapers upwards from a first diameter slightly smaller than an internal diameter of the lower end of the cylindrical body member 105 to a smaller diameter similar to that of the upper portion 107*a* of the screw member 107. The screw member 107, and at least the lower portion 107*b*, is in effect a tapered Archimedes' screw. The internal diameter of the cylindrical body member 105 in the vicinity of the lower portion 107*b* of the screw member 107 is correspondingly tapered from a wide bore towards the lower end of the cylindrical body member 105 to a narrow bore coinciding with the top of the lower portion 107*b* and bottom of the upper portion 107*a* of the screw member 107. Above the tapered portion 105*a* there is provided a shoulder 105*b*, and above that is provided a storage volume or cuttings basket 109 for the storage of drilling cuttings. The screw member 107 and cylindrical body member 105, and particularly the corresponding tapers, provide a seal or barrier against the downwards movement of any cuttings within the cuttings basket 109. Note that the seal need not be a perfect seal as the continuous upward motion of drilling cuttings will ensure negligible backflow of cuttings—likewise a perfect seal need not be provided between the lower portion 107*b* of the screw member 107 and the tapered portion 105*a* of the cylindrical body member 105.

Below the tapered portion 105*a* of the cylindrical body member 105 are provided a number of fluid inlets 111 to receive fluid and any cuttings entrained in the fluid. Immediately below the fluid inlets 111 is located a pump 115 configured for forward circulation of drilling fluid; drilling fluid is thereby drawn from above the inlets 111 into the cylindrical body member 105 through the inlets 111, pumped down through the drill bit (not shown) as indicated by downward arrows. Circulating fluid would then travel back up towards the inlets 111 and be drawn back into the cuttings removal system 103 by the combined action of the pump 115, rotation of the screw member 107 and the pressure drop caused by the increase in the effective annular space. Cuttings produced by the drill bit will be entrained in the circulating fluid and thereby transported to the inlets 111.

Rotation of the screw member 107 (by means of a screw motor, not shown) pulls the drilling cuttings entrained in the drilling fluid up and into the cuttings basket 109 via the lower portion 107*b* of the screw member 107. The provision of a continuous, but smaller diameter, upper portion 107*a* of the screw member above the seal or barrier provided in the vicinity of shoulder 105*b* effect the transport of cuttings towards the upper end of the cuttings basket 109. This will prevent blockage at the seal or barrier and also enable more efficient filling of the cuttings basket 109 than would otherwise be possible. Fluid outlets 113 are provided towards said upper end of the cuttings basket 109 to allow for fluids drawn into the cuttings basket by the action of the screw member 105 to exit into the borehole as indicated by corresponding arrows.

It is also envisaged that the lower portion of the screw member need not be tapered, and in an alternative embodiment the lower portion of the screw member is a fixed diameter.

The use of the screw member addresses a problem identified by the applicant that suction provided by the pump may be insufficient to transfer cuttings into the cuttings basket. Furthermore, use of the screw member means that cuttings collection can be performed regardless of the orientation of the wireline drilling system; even when drilling a horizontal open hole lateral off a vertical wellbore.

In addition, it is advantageous that the cuttings removal system is configured and/or arranged such that there is a pressure differential between the bottom and the top of the system that reduces the potential for fall-back of cuttings and helps retain the cuttings in the cuttings basket.

Figure 2A:
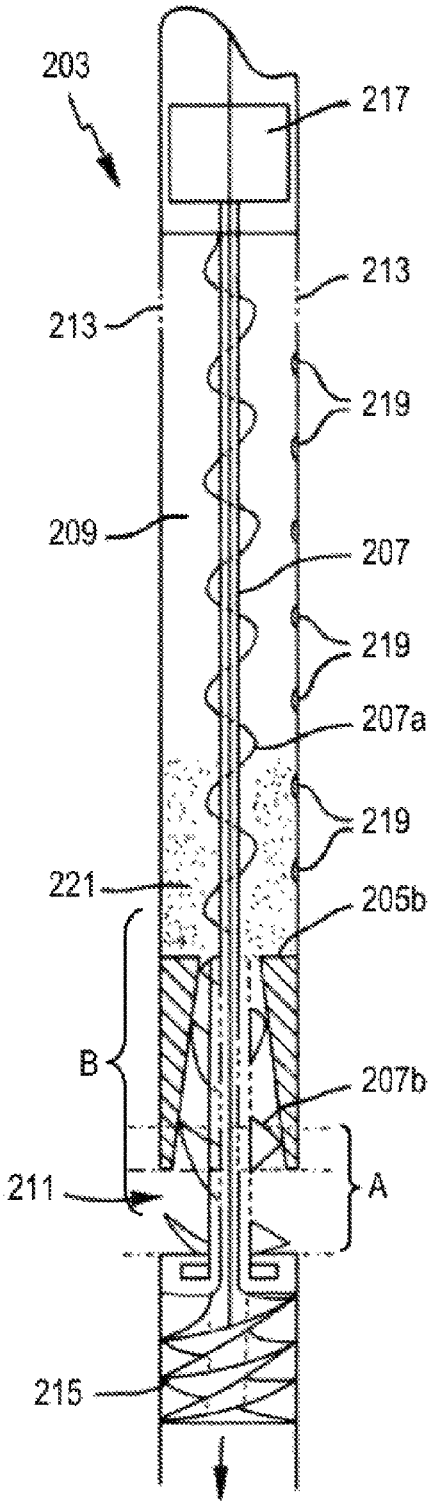
FIG. 2A illustrates in schematic form an alternative cuttings removal system in accordance with an alternative embodiment of the present invention in longitudinal section.
Figure 2B:
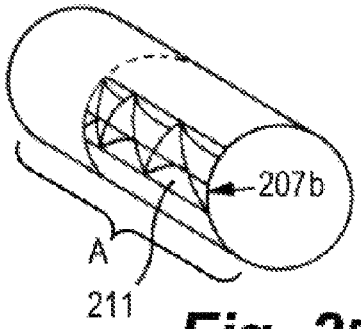
FIG. 2B illustrates a further detail of an inlet for cuttings of the embodiment of FIG. 2A.

FIG. 2A illustrates a cuttings removal system 203 similar to that of FIG. 1, again comprising a hollow cylindrical body member 205 and a screw member 207 extending substantially the full length of the hollow cylindrical body member 205. The screw member is rotated by screw motor 217 which, as described above, causes drilling fluid to be drawn in through the inlets 211 (see FIG. 2B showing a perspective view of the region indicated by reference letter A) and the entrained cuttings firstly drawn up into the cuttings basket 209 by the lower portion 207*b* of the screw member 207 and secondly distributed upwardly within the cuttings basket 209 by the upper portion 207*a* of the screw member 207. Cuttings collected in the cuttings basket are indicated, for the purposes of illustration, by reference numeral 221. Forward circulation is again provided by pump 215, which in this embodiment comprises a large screw type pump.

Figure 2C:
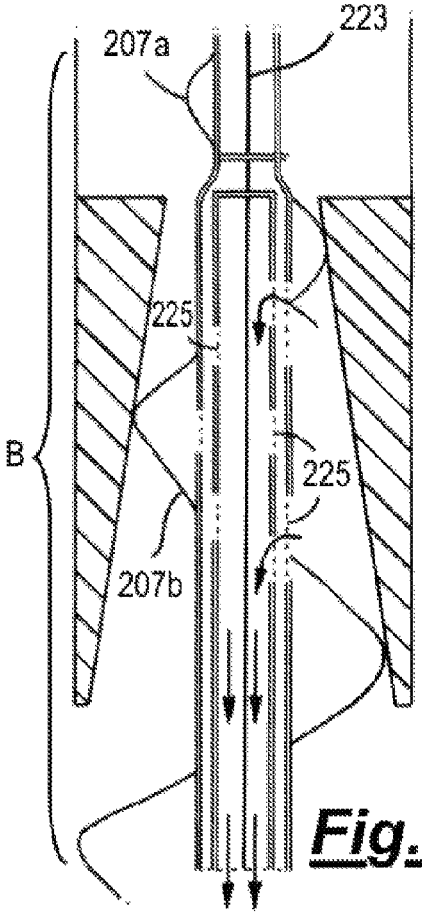
FIG. 2C illustrates a further detail of a tapered screw for transporting cuttings from the inlet of the embodiment of FIGS. 2A and 2B.

Also in this embodiment (see in particular FIG. 2C showing an enlarged view of the region indicated by reference letter B) it can be seen that cable 223 extends through the length of the cuttings removal system 203 to provide power from the top-side wireline (not shown) to the pump 215 and/or to the drilling motor below (not shown) which rotates the drill bit (also not shown). Those features thus far referred to herein but not yet shown may be found in subsequent drawings described below. Furthermore, the lower portion 207*b* of the screw member 207 can be seen to comprise a number of apertures 225 to provide fluid communication between the pump 215 and the borehole via the inlets 211 as indicated by corresponding arrows.

A number of electrodes 219 are shown located on the inner surface of the cuttings basket 209, distributed between the shoulder 205*b* of the hollow cylindrical body member 205 and fluid outlets 213. The electrodes 219 are configured to provide a cuttings basket sensor system that monitors the volume of cuttings contained within the cuttings basket 209.

Figure 3:
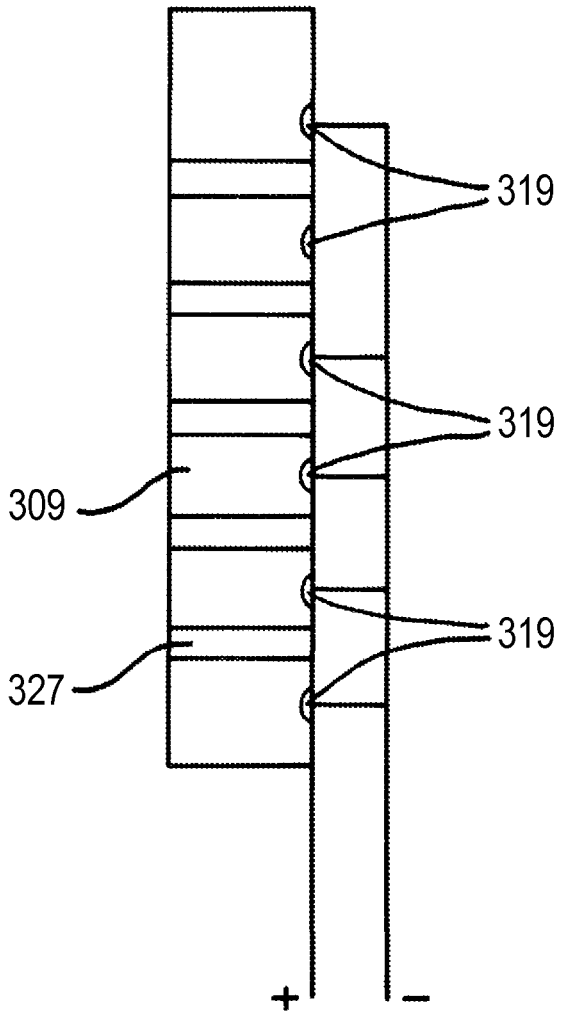
FIG. 3 illustrates in schematic form a cuttings basket sensor for monitoring the volume of cuttings contained within the basket of a wireline drilling system in accordance with an embodiment of the present invention.

FIG. 3 illustrates in further detail an exemplary embodiment of a cuttings basket sensor system operating in a resistivity measurement mode, with multiple electrodes 319 positioned at known intervals along the length of the cuttings basket 309.

The electrodes 319 are separated by insulating portions 327 which serve to isolate neighbouring electrodes along the inner wall of the cuttings basket 309. Application of a known current allows determination of the electrical resistivity of the material between neighbouring electrodes by application of Ohm's Law. Changes in resistivity will be indicative of (a) the presence and (b) the nature of drilling cuttings. When the basket is empty the resistivity will be that of the drilling or borehole completion fluid. As the basket fills up with drilling cuttings the resistivity will increase. Determining resistivity values across all of the distributed electrodes 319 with reference to a geometric constant of the tool provides an indication of the fill level of the cuttings basket 309. As portions of the cuttings basket become filled and the regions between pairs of neighbouring electrodes exhibit correspondingly constant resistivities, these resistivities may be used to give an indication of composition of the cuttings and hence the formation being drilled. Intermediate readings may also provide information relating to composition.

The wireline cable, in addition to its function as a conveyance means and transmission line for supplying electrical power from the surface to the various powered components (e.g. tractor, pump, screw and drilling assembly), is capable of two-way data transmission between the system and the surface. For example, data from the electrodes can be transmitted to the surface, either after processing or in order to be processed, via the wireline cable. In addition, control signals are transmitted from surface down the wireline to the downhole drilling system. Thus the system is controlled and monitored by using the wireline cable for data telemetry in addition to its function as a conduit for supplying electrical power from the surface to the various powered components (tractor, pump, screw and drilling assembly).

Figure 4:
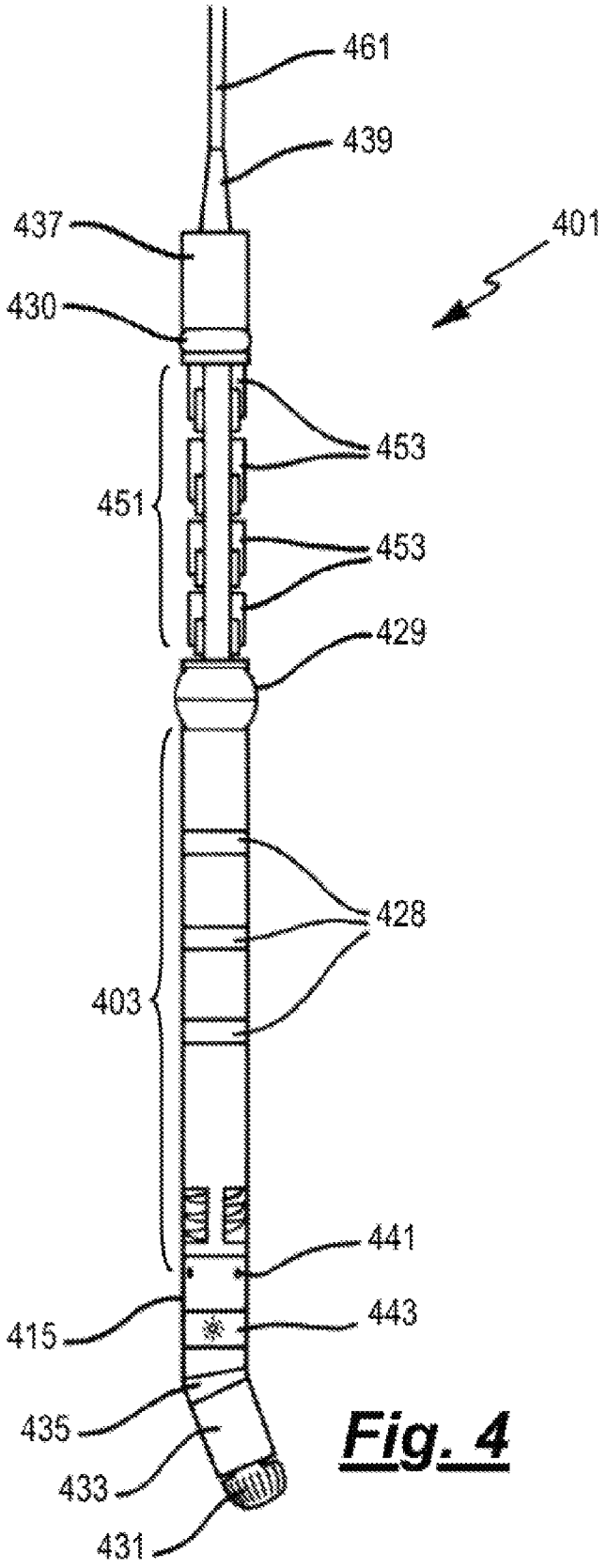
FIG. 4 illustrates in schematic form a wireline drilling system, comprising a tractor and a cuttings removal system, in accordance with an embodiment of the present invention.

Illustrated in FIG. 4 is an embodiment of a wireline drilling system 401. The wireline drilling system comprises a cuttings removal system 403 which is similar to the cuttings removal system embodiments described above. In this embodiment an additional fluid inlet 412 is provided to permit additional borehole completion fluid or drilling fluid to be drawn into the tool by the pump 415—in this embodiment an impeller type pump—and a number of flexible portions 428 comprising rubber elastomers provide the cuttings removal system 403 with a degree of articulation. This is particularly for applications such as in deviated wellbores or when drilling open hole laterals off a parent wellbore where the tool is required to exhibit some flexibility.

Beneath the cuttings removal system 403 is located the drilling assembly comprising the drill bit 431 which is driven by the drill motor housed at 433. An adjustable bend 435 (or directional joint) is provided to allow deviated drilling at a predetermined and/or controllable angle. This bend 435, for example, permits drilling of short radius laterals with very high dog leg sections. An electric motor (not shown) controls the orientation of the bend, and sensors provided to determine direction.

A ball joint 429 connects the cuttings removal system 403 to a drilling tractor 451 above. Again, this is intended to provide an articulation therebetween for flexibility and to rotationally decouple the drilling tractor 451 and cuttings removal system 403. This ball joint 429, in combination with the articulated or flexible portions 428 and a further ball joint 430 above the tractor 451, allows for large deflections along the length of the drilling system 401.

The drilling tractor 451 in this embodiment is powered from the surface via the wireline cable 461. Note that the wireline cable 461 is also the means by which the system 401 is lowered into the well bore and also how the system 401 may be retrieved. In this embodiment, the tractor comprises a number of grippers 453 which are configured to engage the wellbore once the drilling system 401 is in the desired position. (In alternative embodiments, the tractor may comprise a number of wheeled sections—as described in further detail below).

Once engaged, the grippers 453 are driven upwards (relative to the drilling system 401) to progress the drilling system 401 downwards and provide weight-on-bit for drilling operations. When the grippers 453 reach or approach the end of their range of motion they are disengaged from the wellbore and return to the start position where they engage the wellbore again. This repeated action may be termed crawling or walking, and the engagement of the grippers 453 may be coordinated such that all grippers 453 are engaged and disengaged together, but preferably the engagement and disengagement of the grippers 453 is staggered such that continuous forward motion and/or weight-on-bit is provided. The drilling tractor 451 is able to operate at least two speeds, for example with appropriate changeable gearing; one quicker speed for rapidly progressing the drilling system 401 downhole (e.g. a gearing with lower torque) and one lower speed for providing weight-on-bit (e.g. a gearing with higher torque).

Weight-on-bit provided by the tractor 451 is also supplemented by the weight of the system 401 itself. Furthermore, should the drill bit become stuck, require to be picked off bottom, or drilling parameters varied, the tractor 451 can be reversed. Reverse operation of the tractor 451 can be supplemented by pulling on the wireline cable 461 from the surface.

Between the tractor 451 and a swivel 439 (for rotational decoupling between the wireline cable 461 and the drilling system 401) is located a control module 437 which houses control electronics. A number of sensors and sensor systems are also provided within the wireline drilling system 401, in addition to the cuttings basket sensor (not shown—but described above), that provide information to the control module 437.

For example, a near-bit calliper sensor 441 is provided beneath the cuttings removal system 403 to determine the outer diameter of the borehole. In the present embodiment the calliper sensor 441 is of the ultrasonic type, however it is also envisaged that a finger type sensor may be employed, or any other suitable alternative. Note that the volume of the drilled hole can be determined based on the length of wireline cable 471 deployed (plus the length of the drilling system 401) and the diameter of the borehole as determined by the calliper sensor. Comparison of the drilled hole volume and the amount of cuttings in the cuttings basket 409 may be used as a measure of hole cleaning.

An orientation sensor is also provided; in the present embodiment this is housed within the drilling motor module 433. The orientation sensor employs a three-axis accelerometer to determine hole inclination, although in an alternative embodiment a gyroscope or similar may be employed. Hole direction, as well as tool orientation, can be derived from this measurement.

Also provided within the drilling motor module 433 are a RPM sensor (to determine the rotational speed of the drill bit), a torque sensor (to determine the torque being applied to the drill bit) and a weight-on-bit (WOB) sensor (to determine the weight-on-bit). The RPM, torque and WOB measurements allow optimisation of drilling parameters.

Furthermore, an annular pressure sensor 443 (again, near-bit in this embodiment) is provided to monitor the equivalent circulating density of the fluid circulating downhole. Equivalent circulating density, or ECD, is determined by dividing the detected annular pressure by the true vertical depth of the borehole. Changes in ECD may be equated to changes in the amount of cuttings being recirculated. An additional benefit is that by monitoring ECD the risk of a stuck pipe can be determined—for example a larger than expected ECD may be indicative of cuttings beginning to pack off the hole and drilling parameters and/or fluid circulation can be altered to compensate. In the particular application of slim hole drilling, the corresponding small annular volume being monitored permits very accurate determination of ECD—with particular sensitivity to changes in ECD, for example due to cuttings loading or restriction. It is thereby possible to reduce the likelihood of stuck or lost-in-hole tools.

The drilling system itself comprises a large electric motor (housed in drilling motor module 433 and powered from the surface via the wireline cable) and a drilling bit 431, which may be a poly-crystalline diamond compact (PDC) type or diamond impregnated type—although any suitable drill bit may be employed. Coupling to the motor is via a gear box (not shown) to control and optimise drilling parameters.

It is envisaged that a resonating drill head may be employed in order to reduce weight-on-bit requirements. A resonating drill head will also have further applications, such as for fracturing the formation being drilled.

Figure 5:
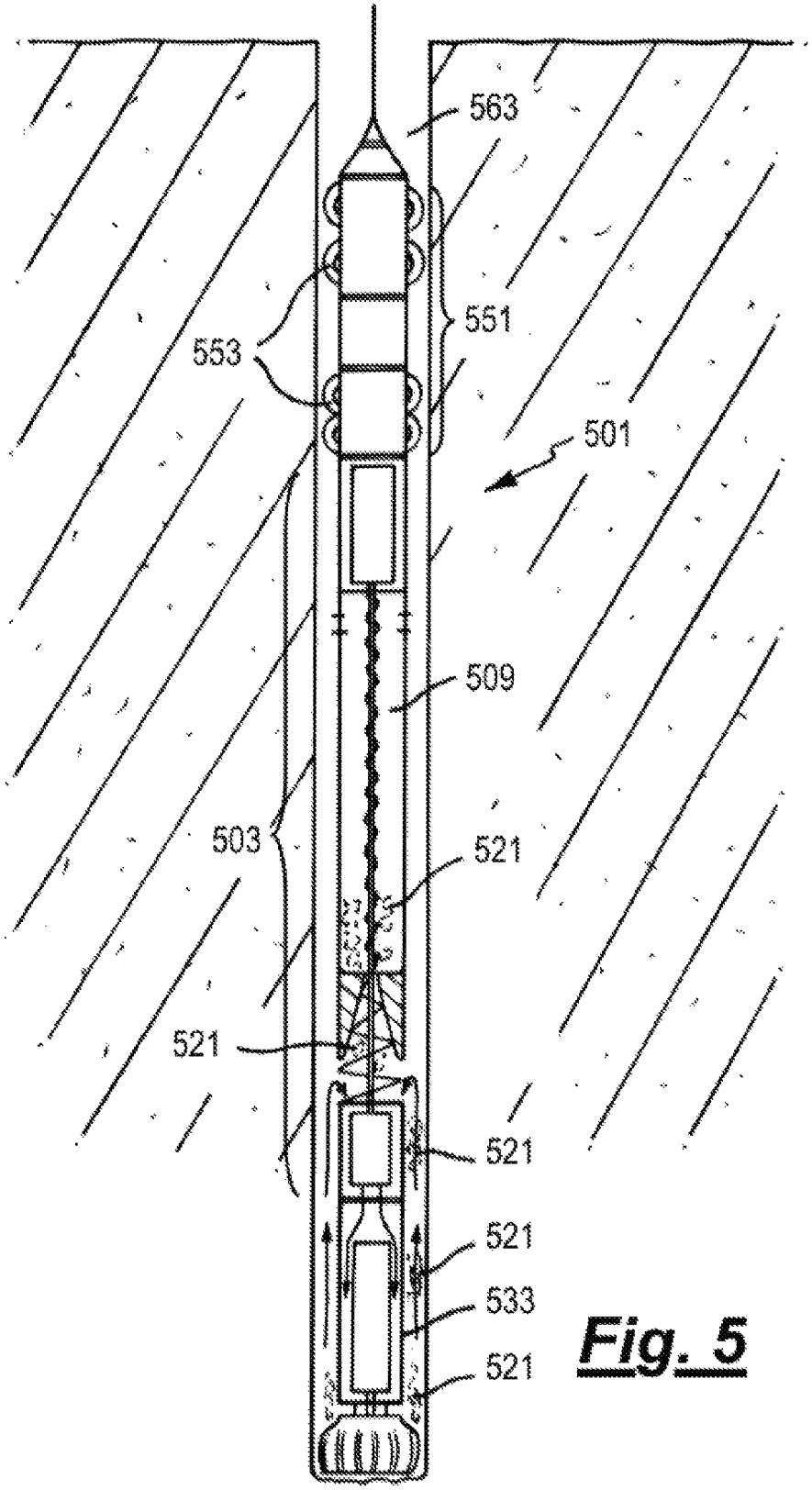
FIG. 5 illustrates in schematic form a wireline drilling system, similar to that shown in FIG. 4, during a drilling operation in an open bore hole, in accordance with an embodiment of the present invention.

FIG. 5 illustrates in schematic form (with a cross-sectional view through the cuttings removal system 503 and drilling motor module 533) an alternative embodiment of the wireline drilling system shown in FIG. 4. For the purposes of illustration, the wireline drilling system 501 is shown performing a drilling operation in an open (i.e. uncased) borehole 563. The cuttings 521 displaced by the drill bit can be seen to be entrained in the circulating fluid (indicated by relevant arrows) and carried up away from the bottomhole whereupon they are captured by the cuttings removal system 503 and stored in cuttings basket 509.

In this particular embodiment, the tractor 551 comprises wheeled portions 553 that engage the wall of the borehole 563 and provide the necessary axial displacement to advance the system 501 and provide weight-on-bit as appropriate—as an alternative to the push-pull crawler type tractor 451 described with reference to FIG. 4.

Figure 6:
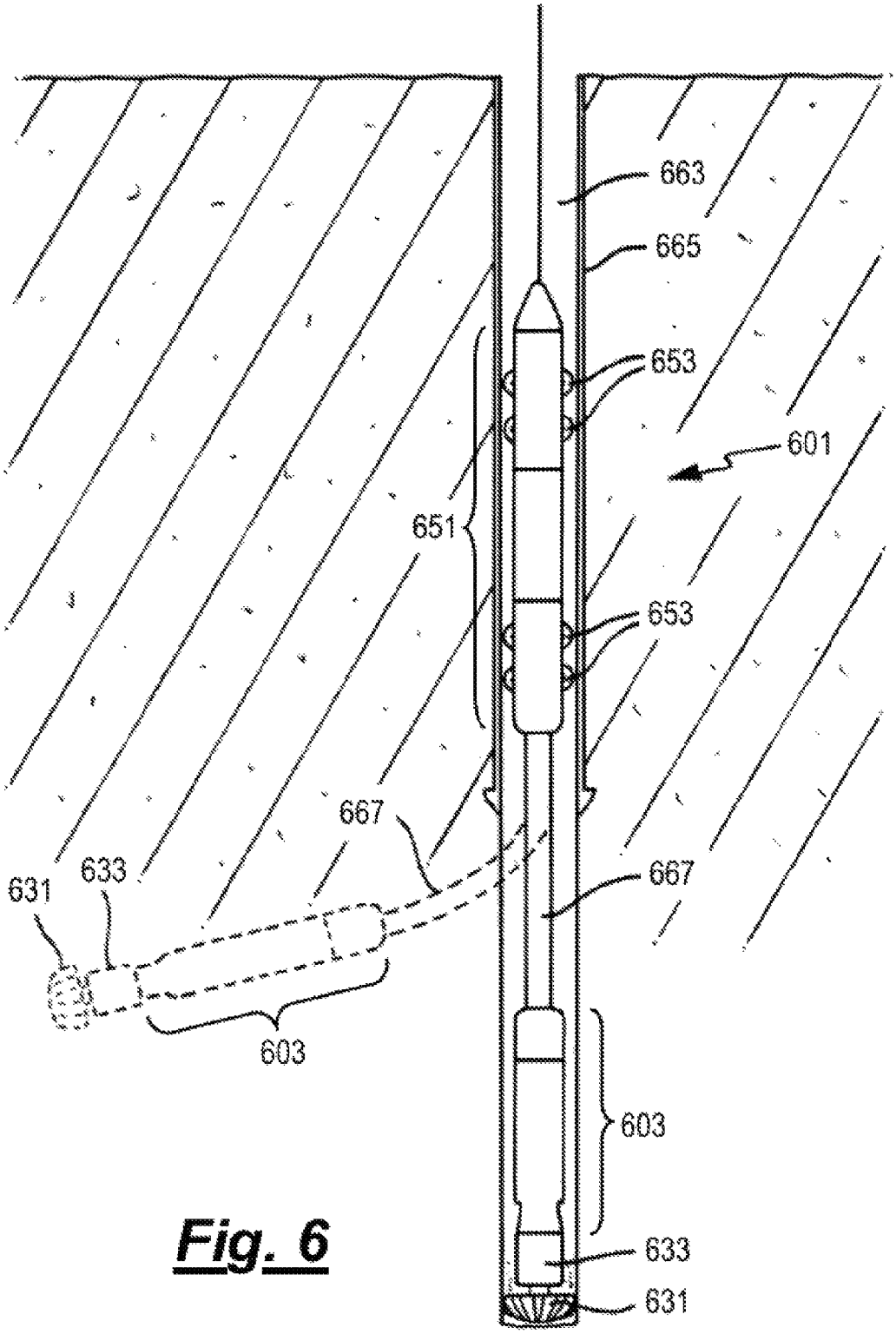
FIG. 6 illustrates in schematic form a wireline drilling system, similar to those shown in FIGS. 4 and 5, during a drilling operation beneath a casing lined bore hole, in accordance with an embodiment of the present invention.

FIG. 6 illustrates in schematic form a further alternative embodiment of the wireline drilling system shown in FIGS. 4 and 5. The wireline drilling system 601 is shown performing a drilling operation beneath a casing-lined borehole 663. The wheeled portions 653 engage the casing 665 while the drilling assembly 631,633 drills an open borehole below. An elongate member 667 couples the tractor 651 to the cuttings removal system 603 and maintains a fixed separation therebetween. This member 667 may be flexible to permit deflection (and perhaps significant deflection) between the tractor 651 and the lower portion of the drilling system 601 comprising the cuttings removal system 603 and drilling assembly 631,633. This is particularly advantageous when—see hatched outline—the wireline drilling system is employed to drill an open hole lateral or to sidetrack an existing well.

Of course, the elongate member 667 may be used to couple tractor 651 directly to the drilling assembly 631,633 without the cuttings removal system 603, and this embodiment (not shown) forms an alternative aspect of the invention for drilling open hole laterals or sidetracking an existing well.

Both the embodiment shown in FIG. 6 and the above described alternative embodiment (without the cuttings removal system) are particularly advantageous as they also allow for the extension of a sidetrack or lateral well by drilling while the tractor, which provides weight-on-bit, is able to remain in the main wellbore. If the main wellbore is cased, for example, these embodiments of the invention can take advantage of improved, or at least predictable, traction and not have to be run into the sidetrack or lateral as well.

FIG. 7 is a flow diagram illustrating an exemplary drilling operation employing a wireline drilling system according to the present invention, such as described with reference to FIG. 4, 5 or 6.

Firstly, the wireline drilling system is run in hole (RIH) to a predetermined depth 771. At this stage the wireline drilling system is in a vertical portion of the borehole. The tractor is then powered up (including engaging grippers, wheeled portions, or the like) and maximum downward force is applied to determine the maximum push force in the vertical hole 773. This can be used to determine equivalent maximum push forces in deviated portions of the wellbore or when drilling open hole laterals off the main borehole.

The tractor is then disengaged from the borehole and the wireline drilling system is then run to the bottom of the hole using the wireline cable 775. Of course, in deviated portions of a well it may be necessary to employ the tractor to progress the wireline drilling system when the deviation is such that the wireline cable and weight of the tool are insufficient for gravity to effect the movement. The full wireline drilling system is then powered up 777, including the drilling assembly and the cuttings removal system. At this stage, measurements are performed using the various sensors provided on the wireline drilling system, including ECD, torque and annular pressure measurements 779.

Drilling is then commenced 781, by engaging the tractor and providing weight-on-bit as previously described. During drilling, fluid is circulated and entrains drilling cuttings removed by the drill bit. These are collected in the cuttings basket as described in detail above. During drilling the fill level of the cuttings basket is continuously monitored, as well as the ECD. Assuming normal sensor readings, drilling continues until the cuttings basket is (for example) 50% full 785, at which time the wireline drilling system is withdrawn from the cutting face at bottomhole and ECD and wireline tension measured 787.

Again assuming normal sensor readings, drilling is resumed 789 until the cuttings basket is 100% full 791, at which time drilling is ceased and the wireline drilling system is again withdrawn from the cutting face at bottomhole 793. Once sensor readings have returned to the baseline values established prior to commencing drilling, the wireline drilling system is pulled out of the hole (POOH) to the surface 795 using the wireline cable. POOH may be assisted by operation of the tractor in the event of blockage or sticking.

Once withdrawn, the cuttings basket can be emptied 797 and if further drilling is required the process can be repeated, as often as is necessary, from the step of running the wireline drilling system to bottomhole 775.

In the event that abnormal sensor readings are determined at any stage during monitoring of the cuttings basket and ECD 783 or when monitoring the ECD and wireline tension 787, the wireline drilling system is withdrawn from the cutting face at bottomhole until sensor readings return to normal 784,788. If need be the wireline drilling system can be POOH if readings do not return to normal within a predetermined time interval. Furthermore, circulation of fluid and collection of drilling cuttings can be performed independently of drilling if it is determined that there is an abundance of cuttings that require clearing to prevent sticking of the drill bit.

Intermediate steps are also envisaged in which the orientation of the drill bit is adjusted using an adjustable bend (or directional joint) of the wireline drilling tool. Orientation may be monitored using accelerometer or gyroscopic sensors. Adjusting the orientation will allow deviated drilling at a predetermined and/or controllable angle (as previously described) to permit drilling of short radius laterals (such as illustrated in FIG. 6).

It is also envisaged that the initial deviation from the wellbore may be facilitated by use of a whipstock. This can be a conventional whipstock or, for example, a wireline conveyed whipstock.

Figure 8A:
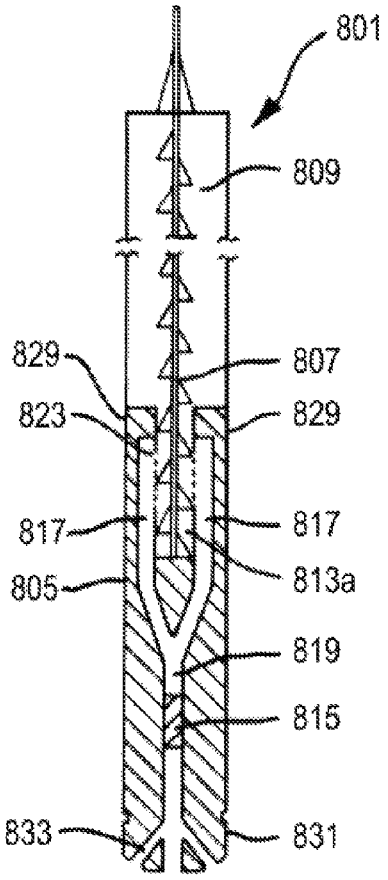
FIGS. 8A to 8D illustrate a wireline drilling system according to an alternative embodiment of the invention, respectively in a pair of longitudinal sectional views, and a pair of cross-sectional views.
Figure 8B:
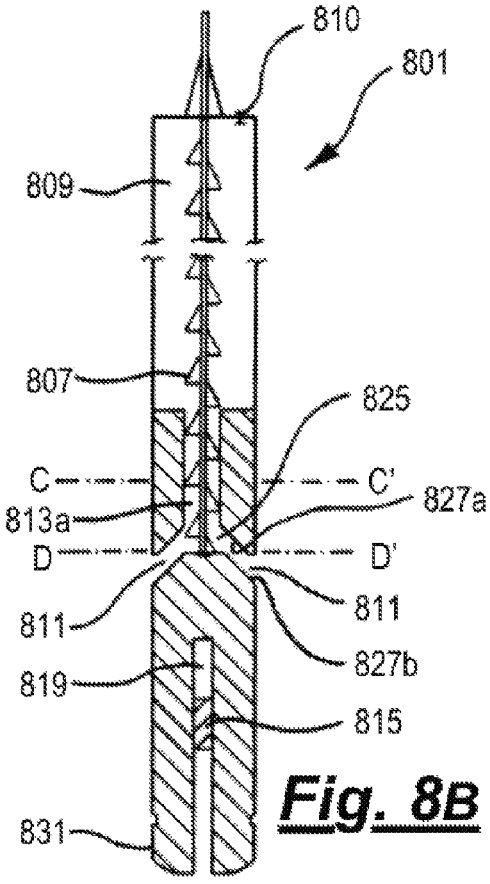
Figure 8C:
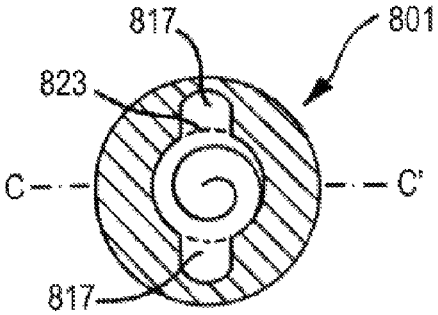
Figure 8D:
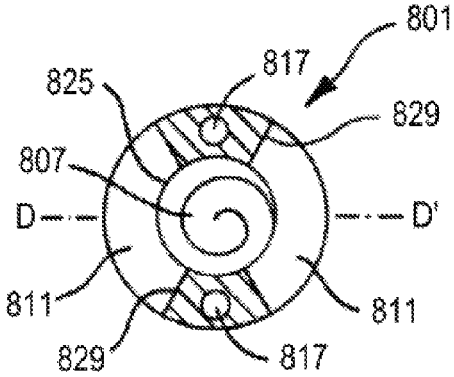

Referring now to FIGS. 8A to 8D, there is described a further embodiment of the invention, generally depicted at 801. FIGS. 8A and 8B are mutually perpendicular longitudinal sectional views of the wireline drilling system 801, and FIGS. 8C and 8D are cross-sectional views through lines C-C' and D-D' of FIG. 8B respectively. The wireline drilling system 801 is similar to the systems 103 and 203, and will be understood from FIGS. 1 and 2 along with the accompanying description. However, the system 801 differs in details of its internal geometry and circulation flow path.

The wireline drilling system 801 comprises a partially hollow cylindrical body member 805 which incorporates a rotary drill bit 831 at its lower end. A screw member 807 extends along a part of the length of the cylindrical body member 805 within a cylindrical space 813. The cylindrical space 813 comprises openings at a lower portion 813*a*, and the screw member 807 extends from the lower portion to a cuttings receptacle (or basket) 809. As before, the screw member 807 functions to transport drilling cuttings entering the cylindrical space 813 upwards in the tool towards the cuttings receptacle by a lifting action. The cuttings receptacle is provided with a pressure equalising valve 810.

Apertures 811 in the body member 805 provide inlet paths into the body for a mixture of drill cuttings and drilling fluid in the wellbore. The apertures 811 are located at diametrically opposite sides of the body member 805 and are longitudinally displaced an equal distance from the lower end of the body member and drill bit 831. The apertures 811 provide fluid communication between the annular space outside of the body 805 and openings 825 to the lower part 813*a* of the cylindrical space 813. The apertures 811 are arranged at an angle inclined to the normal radial direction of the body 805, and have an axial component in the direction of the body, directed upwards from the outside surface of the body towards the screw member 807. The apertures 811 are bounded by upper and lower conical surfaces 827*a*, 827*b*, but are not continuous circumferentially around the body. Instead the apertures 811 are bound in a circumferential direction by mandrel portions 829 which extend axially through the apertures 811.

The mandrel portions accommodate outlet conduits 817 which are axially oriented in the body 805. The outlet conduits provide a fluid path extending downwards from a filter 823 comprising a screen or mesh located above the lower portion 813*a* of the cylindrical space, to a central bore 819. The outlet conduits 817 are therefore isolated from the apertures 811, but provide a circulation path from the apertures 811 to the central bore 819 via the cylindrical space 813 into which the screw member 807 penetrates. A circulation pump 815 in the central bore is operable to create fluid circulation between the apertures 811 and the outlet apertures 833 located in the drill bit 831.

In use, the drill bit is rotated by an electrical drive motor (not shown) to extend the depth of the borehole being drilled. The circulation pump 815 is operated to create a differential pressure which tends to draw a drilling fluid and cuttings mixture into the apertures 811 and into the lower portion 813*a* of the cylindrical space where they come into contact with the screw member 807. The screw member transports cuttings upwards and away from the inlet apertures 811 to the cuttings receptacle 809. The filter 823 enables fluid to exit the cylindrical space 813 into the outlet conduits, but retains the solid cuttings in the cylindrical space as they are lifted to the cuttings receptacle. Fluid is then re-circulated into the wellbore via the central bore 819 and pump 815.

The flow geometry of the embodiment of the invention is configured to offer a number of practical advantages to the efficient functioning of the system in the separation of solids and fluids. Firstly, the inlet path from the annulus to the circulation pump is arranged across the screw member, rather than in axial proximity to the screw member, to increase the proportion of cuttings coming into contact with the screw member to be lifted into the cuttings receptacle. Secondly, the inlet paths created by the apertures 811 are oriented at an angle inclined to a normal radial direction of the body (i.e. they have an axial directional component). This facilitates the provision of a large flow area through the screw member.

In addition, the relative orientation of a filter mesh or screen and the screw member facilitates cleaning of the filter by the rotation of the screw. This is an effective way of keeping the filter clear of solids and maintaining the circulation path during operation.

The various features of the flow geometry of this embodiment combine to provide an efficient means for collection, storage and/or removal of drilling cuttings when drilling or sidetracking wellbores, or drilling open hole laterals from a main wellbore in well intervention operations.

The wireline drilling system described herein, in addition to numerous other applications that will be readily apparent to the skilled person, finds particular utility in enhancing oil and gas production from existing wells. For example, in low cost wells where conventional well intervention methods are problematic because they are not cost-effective and require significant interruption of production, the present invention may be quickly deployed with minimal down-time. Furthermore, in contrast to radial drilling using coiled tubing and jetting technology as known in the art, the present invention allows drilling technology to be used, which can be more effective, and allows usage of lower cost wireline deployment systems.

The invention provides a wireline drilling system for the hydrocarbon exploration and production industry incorporating a drilling cuttings removal system which acts to remove and store cuttings displaced by a drill bit during drilling operations. The cuttings removal system may employ a screw member having a tapered lower portion and a narrow upper portion to transport drilling cuttings to a cuttings basket and distribute the cuttings therein. Embodiments of the invention include an integral tractor to progress the wireline drilling system and provide weight-on-bit, as well as assist in retrieval of the wireline drilling system if the tool should become stuck. In its various embodiments, the invention provides or supports efficient well intervention.

Various modifications may be made within the scope of the invention as herein intended, and embodiments of the invention may include combinations of features other than those expressly claimed. For example, features of the drilling systems described with reference to FIGS. 4, 5, 6 and 8 may be combined to provide further alternative embodiments while remaining within the scope of the appended claims. One particular example is that the lower portion of the screw member of the cuttings removal system, described herein as being tapered, might equally be of fixed diameter.

The invention claimed is:

1. A wireline drilling tool comprising a drilling assembly configured to drill an extension to an existing wellbore including a drill bit configured to remove a full diameter of rock whose axis is substantially the same as that of the wellbore, and an integral cuttings removal system arranged to collect and store rock cuttings drilled by the drilling assembly for transport to the surface, the integral cuttings removal system comprising a cuttings basket to store the drilling cuttings whose volume is equal to or greater than the volume of the dilled extension and a rotatable screw member operable to carry drilling cuttings along at least a portion of the integral cuttings removal system, and an integrated downhole pump configured to circulate fluid between the drilling assembly and the rotatable screw member via one or more first inlets positioned at or near a lower portion of the screw member.

2. A wireline drilling tool according to claim 1, wherein the rotatable screw member is operable to transport cuttings to the cuttings basket.

3. A wireline drilling tool according to claim 1, wherein the rotatable screw member is operable to distribute cuttings within the cuttings basket.

4. A wireline drilling tool according to claim 1, wherein the rotatable screw member comprises a first portion and a second portion, the first portion arranged to distribute cuttings within the cuttings basket, and the second portion arranged to transport cuttings to the cuttings basket.

5. A wireline drilling tool according to claim 4, wherein the cuttings removal system comprises one or more second inlets positioned at or near the second portion of the screw member.

6. A wireline drilling tool according to claim 5, wherein the integrated downhole pump is configured to draw fluid into the first inlets and to discharge the fluid adjacent the drilling assembly.

7. A wireline drilling tool according to claim 1, wherein the wireline drilling tool further comprises a tractor configured to selectively engage the wellbore and produce an axial displacement of the wireline drilling tool within the wellbore.

8. A wireline drilling tool according to claim 7, wherein the tractor is configured to displace the wireline drilling tool at two or more different speeds.

9. A wireline drilling tool according to claim 7, wherein the tractor is configured to provide weight on bit to urge the drilling tool against a formation being drilled.

10. A wireline drilling tool according to claim 7, wherein the wireline drilling tool comprises one or more articulated portions to permit longitudinal deflection of the wireline drilling tool.

11. A wireline drilling tool according to claim 7, wherein the tractor is coupled to the cuttings removal system by a flexible elongate member which provides an axial separation therebetween.

12. A wireline drilling tool according to claim 1, wherein the cuttings basket comprises at least one sensor responsive to a quantity of cuttings contained therein.

13. A wireline drilling tool according to claim 12, wherein the at least one sensor is configured to determine a formation composition based on the resistivity of cuttings in the cuttings basket.

14. A wireline drilling tool according to claim 1, wherein the wireline drilling tool further comprises an adjustable bend arranged to effect an off-axis deviation of the drilling assembly.

15. A wireline drilling tool according to claim 14, wherein the adjustable bend is controllable to control a drilling direction.

16. A wireline drilling tool according to claim 1, wherein the wireline drilling tool further comprises one or more sensors selected from the group comprising; a calliper sensor to determine the diameter of the wellbore; an orientation sensor to determine the orientation of the drilling assembly; a pressure sensor to determine the annular pressure in the wellbore; an RPM sensor to determine the speed of rotation of the drill bit; a torque sensor to determine the torque applied to the drill bit; and a weight-on-bit sensor to determine the weight-on-bit.

17. A wireline drilling tool according to claim 16, wherein the wireline drilling tool further comprises a control module configured to control drilling operations responsive to information received from the one or more said sensors.

18. A wireline drilling tool according to claim 1, wherein the drill bit is a resonating or oscillating drill bit.

19. A method of drilling a wellbore, the method comprising:

providing a wireline drilling tool comprising a drilling assembly with a drill bit and an integral cuttings removal system, the integral cuttings removal system comprising a cuttings basket and a rotatable screw member;

running the wireline drilling tool into the wellbore;

drilling a subterranean rock formation with the wireline drilling tool to further extend the wellbore into the subterranean rock formation;

operating a pump of the wireline drilling tool to circulate fluid between the drilling assembly and the rotatable screw member via one or more inlets positioned at or near a lower portion of the rotatable screw member;

operating the rotatable screw member to carry drilling cuttings along at least a portion of the integral cuttings removal system; and collecting cuttings displaced by the drilling assembly.

20. A method of drilling according to claim 19, further comprising retrieving the wireline drilling tool, at least once, to dispose of the collected cuttings.

21. A method of drilling according to claim 19, further comprising determining a formation composition based on the resistivity of the contents of the cuttings basket.

22. A method of drilling according to claim 19, further comprising rotating the screw member to transport drilling cuttings to the cuttings basket.

23. A method of drilling according to claim 19, further comprising rotating the screw member within the cuttings basket to distribute cuttings within the cuttings basket.

24. A method of drilling according to claim 19, further comprising circulating fluid between the drilling assembly and the cuttings removal system via one or more inlets.

25. A method of drilling according to claim 19, further comprising producing an axial displacement using a tractor of the wireline drilling tool to provide weight on bit to urge the drilling assembly against the subterranean rock formation being drilled.

26. A method of drilling according to claim 19, further comprising powering up a tractor of the wireline drilling tool at an intermediate position in the wellbore to determine a maximum push force.

27. A method of drilling according to claim 19, further comprising controlling the drilling direction to drill open hole laterals from the wellbore.

28. A method of drilling according to claim 19, further comprising ceasing drilling operations or reciprocating the wireline drilling tool off bottom responsive to information received from one or more sensors.

29. A method of drilling according to claim 28, further comprising resuming operations and/or bottomhole placement responsive to changes or lack of changes in the information received from the one or more sensors.

* * * * *